United States Patent [19]

Sakata et al.

[11] Patent Number: 4,588,181

[45] Date of Patent: May 13, 1986

[54] DOUBLE-FEED PREVENTION DEVICE IN PAPER FEEDING APPARATUS

[75] Inventors: Kei Sakata, Wakayama; Kazunori Tanaka, Atsugi; Kazunori Aiuchi, Kawasaki, all of Japan

[73] Assignee: Duplo Seizo Kabushiki Kaisha, Japan

[21] Appl. No.: 590,221

[22] Filed: Mar. 16, 1984

[30] Foreign Application Priority Data

Mar. 18, 1983 [JP] Japan ..... 58-44481

[51] Int. Cl.[4] ..... B65H 3/52

[52] U.S. Cl. ..... 271/121

[58] Field of Search ..... 271/121, 124, 125, 167

[56] References Cited

U.S. PATENT DOCUMENTS 3,157,868 11/1964 Buslik ..... 271/121 X

FOREIGN PATENT DOCUMENTS 2332034 1/1974 Fed. Rep. of Germany ..... 271/124

*Primary Examiner*—Richard A. Schacher

*Attorney, Agent, or Firm*—Pearne, Gordon, Sessions, McCoy, Granger, Tilberry

[57] ABSTRACT

A double-feed prevention device in paper feeding apparatus is provided with a paper feeding roller and a frictional member carried on a paper separating plate mounted on an end of a spring-biased swingable lever. Paper sheets are separated one by one at a gap having a predetermined dimension between the paper feeding roller and the frictional member. A part of the swingable lever is always engaged by a locking member so as to prevent separation of said frictional member from said paper feeding roller by wear off in a surface of said paper feeding roller. The double-feed prevention device according to the present invention is further provided with releasing means for disengaging between the locking member and the swingable lever to remove jammed paper from the gap as desired.

9 Claims, 10 Drawing Figures

DOUBLE-FEED PREVENTION DEVICE IN PAPER FEEDING APPARATUS

BACKGROUND OF THE INVENTION

The present invention relates to a double-feed prevention device in paper feeding apparatus, and more particularly, to such a device especially adapted to avoid the double-feed of paper sheets which tends to occur due to the wear of a surface of a paper feeding roller.

In paper feeding apparatus used for various machines such as printing, copying, paper folding and the like, it is highly desirable to feed single sheets of paper from a stack of paper sheets placed on a paper feeding plate. There are many known prior art devices for single sheet feeding of paper.

A particularly reliable single sheet feed device is disclosed in Japanese Patent No. 850580. In accordance with this patent, a paper feeding roller is opposed by a paper separating plate having a friction member mounted thereon. The paper separating plate is resiliently biased by a lever toward the paper feeding roller. The paper sheets fed between the feeding roller and the friction member being separated into single sheets of paper from the other sheets in the same manner as two sheets of paper are separated by hand by slipping one off the other with relative movement between the thumb and index finger.

The above prior art apparatus requires careful selection of the force biasing the paper separating plate against the paper feeding roller since paper buckling and jamming results if the biasing force is too high, or double sheet feed results if the force is too low. In order to improve the feed reliability of this device, an adjustable fixed mechanical stop is used to regulate the position of the paper separating plate. The stop is adjusted to prevent a gap between the friction member and the paper feeding roller from widening beyond a dimension or thickness corresponding with that of a single sheet of paper.

The use of such stops in prior feed devices has not been entirely satisfactory since wear of opposed members requires frequent adjustment of the stops. Further, the required adjustments are too delicate and troublesome to be done efficiently using conventional manual procedures.

Also, when any buckling or jamming of a paper sheet occurs, such jammed paper sheet must be removed from the device by releasing the stopper, and thereafter the stopper must be re-adjusted by delicate manual operation.

SUMMARY OF THE INVENTION

A first object of the present invention is, in view of the above-mentioned problems, to provide a double-feed prevention device in paper feeding apparatus so improved that, even when a surface of a paper feeding roller has worn off for a long period of use, a gap defined between said paper feeding roller and a paper separating plate (inclusive of a frictional member if said plate is provided with such frictional member) is sufficiently and automatically adjusted within a predetermined dimension and thereby double-feed of paper sheets can be prevented.

A second object of the present invention is to provide a double-feed prevention device in paper feeding apparatus wherein, when a problem such as buckling of a paper sheet has occurred in spite of said automatic adjustment of the gap, not only can such jammed paper sheet be easily removed, but also, the restoration of the gap adjustment of the respective members can be automatically accomplished for a predetermined dimension.

The above objects are achieved by a double-feed prevention device according to the present invention which comprises a paper feeding roller in opposition to a paper separating plate having a frictional member. The paper separating plate is carried by an end of a swingable lever resiliently biased against the paper feeding roller. A portion of the swingable lever is always engaged by a locking member so as to prevent separation of the paper separating plate from the paper feeding roller by wear off of a surface of the paper feeding roller. The double-feed prevention device according to the present invention further includes a releasing means for disengaging the locking member and the swingable lever in order to fulfill the second object of the present invention.

DESCRIPTION OF THE EMBODIMENTS

Figure 1:
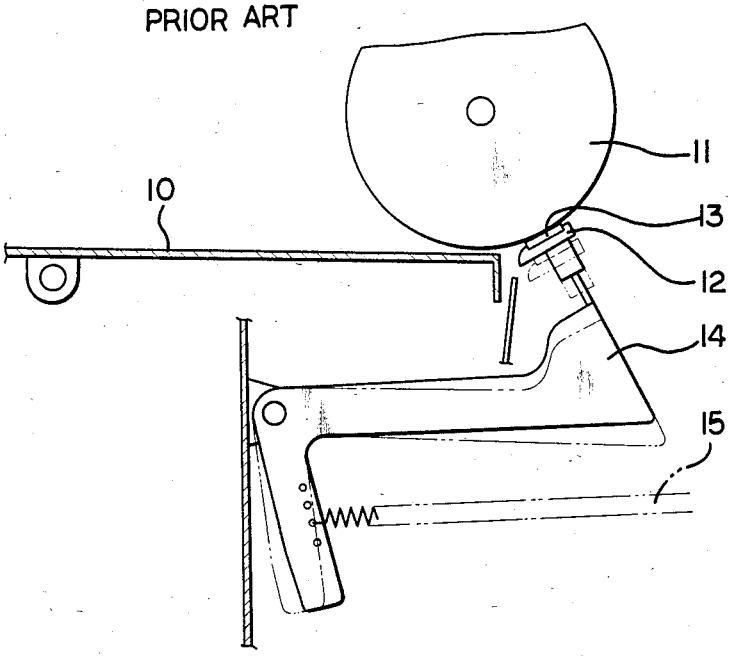
Fig. 1 PRIOR ART
FIG. 1 is a fragmentary, elevational side view of a double-feed prevention device in accordance with the prior art.
Figure 2:
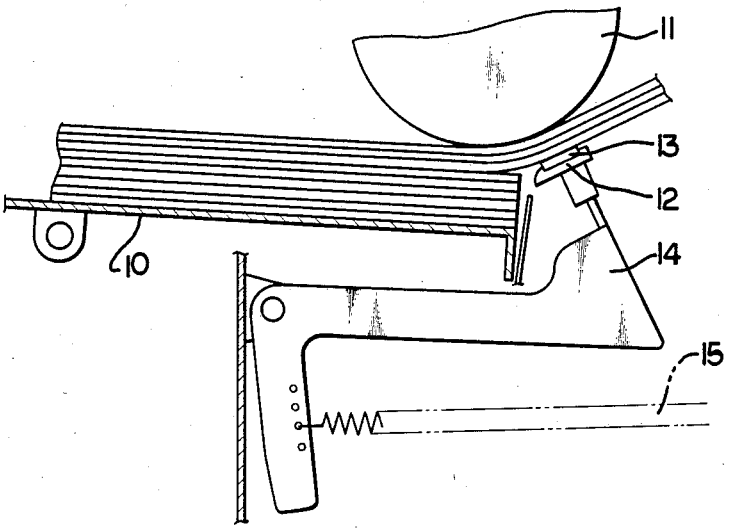
Fig. 2 PRIOR ART
FIG. 2 is a view similar to FIG. 1, but on an enlarged scale, showing a double sheet feed occurring in the device of FIG. 1.

The prior art teachings of Japanese Patent No. 850580, briefly summarized above, are discussed in greater detail below with reference to FIGS. 1 to 3 of the drawings.

The prior art double-feed prevention device includes as its major components a paper separating plate 12 having a frictional member 13 in opposition to a paper feeding roller 11. The paper separating plate 12 is normally resiliently biased by a lever 14 against the paper feeding roller 11, in front of the paper feeding table, using a restoring force such as that provided by spring 15. Thus, the paper sheets fed between the plate 12 and the roller 11 are separated by shear forces which cause one sheet to slip off the other.

The biasing force imposed by the spring 15 must be carefully selected. Since the paper may be buckled or jammed if the force applied by the spring 15 is excessively high, there is a tendency to use a spring of relatively low biasing force. On the other hand, the use of a low biasing force spring may result in a tendency for the paper separating plate 12 to apply an insufficient force to the roller 11 and to be too easily separated therefrom. This makes reliable single sheet separation difficult and sometimes even causes double-feed when paper sheets having relatively more cohesive surfaces are to be fed in the apparatus as shown in FIG. 2.

Figure 3:
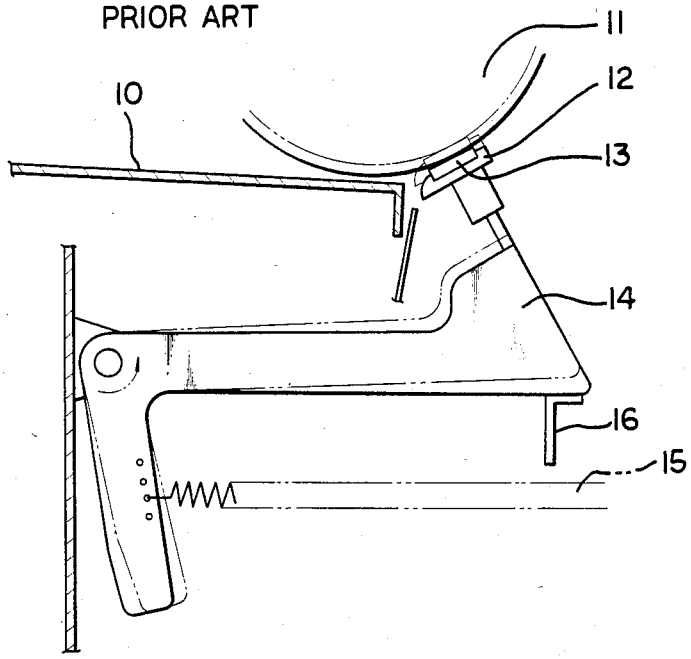
Fig - 3 PRIOR ART
FIG. 3 is a view similar to FIG. 1 showing the use of a stopper in such device in accordance with the prior art.

In resolution of such problems, the prior art teaches use of a stopper 16 arranged to engage one swingable part or arm of the lever 14 as shown in FIG. 3. The swinging range or pivotable movement of the lever 14 is thereby limited to prevent a gap between the frictional member 13 and the paper feeding roller 11 from widening beyond a spacing corresponding to the thickness of a single paper sheet. However, the gap permitted between the frictional member 13 and the paper feeding roller 11 may be progressively increased to a critical degree at which the double-feed readily occurs, since the surface of the roller 11 is worn during prolonged operation and the diameter of the roller is decreased. To avoid this, the stopper 16 must often be manually adjusted to a proper position. Such manual adjustment must be repeatedly performed since the wearing of the roller 11 progresses with time. For many users, such adjustment of the permitted gap is too delicate and troublesome.

Also, any buckling or jamming of paper sheets occurring in spite of the proper gap being maintained by said operation of adjustment will require removal of such jammed paper sheet, by releasing the stopper 16 from its adjusted position and then repetition of the delicate, manual adjustment of said stopper 16, which will disadvantageously require much more time and labor for operation.

Figure 4:
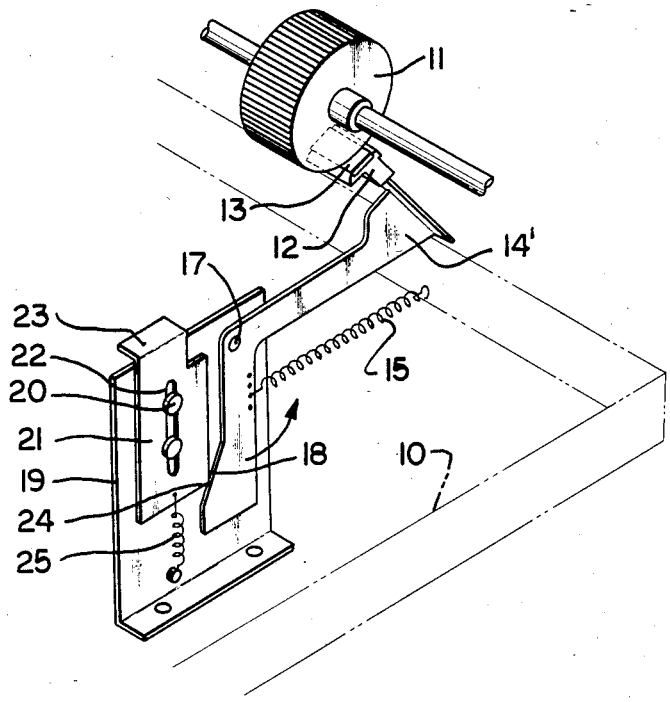
FIG. 4 illustrates, in a perspective view, an embodiment of the double-feed prevention device constructed according to the present invention.

Referring to FIG. 4, a double-feed prevention device accordin9 to the present invention is shown. (In the followin9 discussion, the same reference numerals are applied to correspondin9 components or elements with the addition of prime or letter suffix designations to identify modified elements.)

The device according to the present invention includes a paper feeding plate 10, shown in phantom outline, pivotally supported with its front end biased upwards. The paper feeding roller 11 is disposed in opposition to the plate 12 which includes the frictional member 13. The paper separating plate 12 is carried by an end of a lever 14' supported on a pivot 17 and normally biased under the force of spring 15 against the paper feeding roller 11.

The pivot 17' is mounted on a supporting plate 19 which is stationarily mounted on a machine frame in a vertical orientation. A swingable portion of the lever 14' which extends downward from the pivot 17 has an L-shape and it is swingable in unison with the remaining portion of the lever as a whole. The swingable portion of the lever 14' includes a slant edge as a portion 18 to be actuated.

A locking member 21 is mounted on the supporting plate 19, which includes an actuating portion 24 located adjacent the portion 18 to be actuated and adapted to be movable transversely of the portion to be actuated in a swinging plane thereof. The locking member 21 is slidable relative to the supporting plate 19 along two screws 20, 20 threaded into the supporting plate 19 through a slit 22 formed in the locking member 21, the two screws being vertically spaced from each other.

The locking member 21 has an L-shaped tab 23 at its upper end. The locking member 21 is downwardly biased by a spring 25 so that a lower corner edge serving as the actuating portion 24 is always maintained in engagement with the slant edge of the swingable portion of the lever 14' serving as the portion 18 to be actuated. So far as the locking member 21 has a sufficient weight, the locking member 21 will be sufficiently biased downwards under an effect of gravity and, in such case, the spring 25 may be unecessary.

In this embodiment, if surface wear in the surface of the paper feeding roller 11 occurs during use of the device then the lever 14' moves in a counterclockwise or arcuate swinging direction under a traction of the spring 15 as shown by an arrow in FIG. 4. During such movement, the locking member 21 remains in engagement with the lever 14'. More particularly, the actuating portion 24 under the traction of spring 25 and/or gravity follows the swinging movement of the portion 18 to be actuated and the lever 14'. Accordingly, the portion 24 thereby progressively moves downward in an automatic manner and the frictional member 13 carried by the paper separating plate 12 is always maintained at a predetermined dimension from the paper feeding roller 11, in spite of wear in the surface of the paper feeding roller 11 due to the following of the locking member 21. Thus, the gap defined between the friction member 13 and the paper feeding roller 11 is always kept in its initial condition prior to the occurrence of such wear in the roller 11. Therefore, it is possible to maintain a stabilized paper feeding performance and at the same time double-feed can be prevented.

The spring 25 serving to pull the locking member 21 is relatively weak so that the biasing effect for the paper separating plate 12 to be brought against the paper feeding roller 11 is substantially free from any influence of this spring 25. Thus, there is no danger that the biasing force might be large enough to cause the previously mentioned buckling and jamming of paper sheets.

In the foregoing embodiment, when buckling or jamming of a paper sheet occurs by occasions such as the surface quality of the paper or a change of the room conditions, for example, as in a rainy season, between the paper feeding roller 11 and the paper separating plate 12, such jammed paper sheet must be removed by depressing the paper separating plate 12. This is achieved in the following embodiments shown in FIGS. 5A, 5B and 5C by releasing means which cooperates with the locking member. The releasing means respectively comprise releasing members **30*a*, 30*b* and 30*c* in FIGS. 5A–5C. In a similar manner, the levers and locking members are identified with suffix letter designations. For purposes of convenience, the remaining members or elements having the same functions as those in the embodiment of FIG. 4 are designated by the same reference numerals and the manners in which the respective members operate, except for the releasing members, will be apparent from the foregoing description. In each of these embodiments, the lever, the releasing member, the locking member and the other members are different in their shapes and/or relative positions. However, these embodiments are merely variations of the embodiment of FIG. 4** except that the releasing members are provided.

Figure 5A:
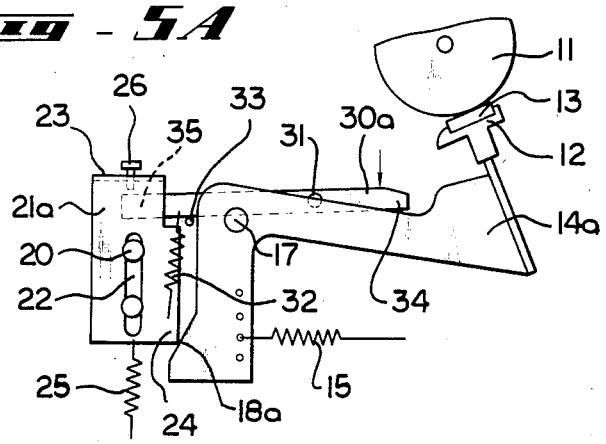
FIG. 5A, FIG. 5B and FIG. 5C schematically illustrate a series of embodiments which are commonly provided with a releasing member but different in aspects such as the shapes and relative positions of various members including levers and stoppers.
Figure 5B:
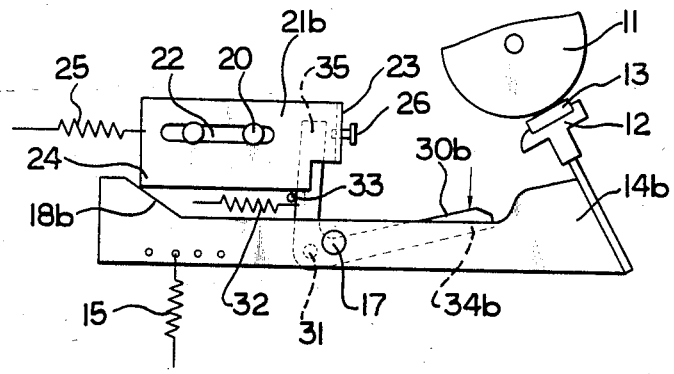
Figure 5C:
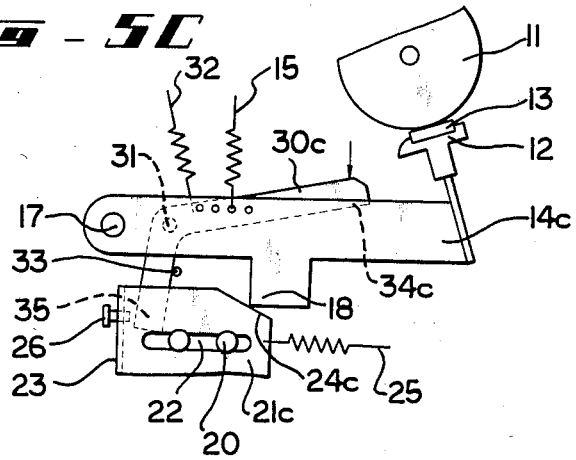

The portion 18 of the lever **14*a* to be actuated is in the form of a corner edge and the actuating portion 24*c* of the locking member 21*c* is in the form of a slant edge in the embodiment of FIG. 5C, while the corresponding members have inverted forms relative to those members of FIG. 5C in the embodiments shown by FIGS. 5A and 5B. Thus, the shapes of the portion 18 to be actuated and the actuating portion 24** are never limited to any specified shapes. For example, it is possible that the former is realized as a periphery of a loose hole and the latter is realized as a pin or like loosely inserted into said hole. It should be understood here that the terms "slant edge" and "corner edge" include not only linear configurations, but also curved configurations such as those having predetermined radii as will be described later in more detail with respect to still another embodiment.

In the embodiments shown in FIGS. 5A through 5C, each of the releasing members 30*a*, 30*b* and 30*c* is swingably supported on a pivot 31 and normally counterclockwise biased by a spring 32 against a stopper 33. Although each of the releasing members is shown to be supported on the pivot 31, it is also possible to support such members coaxially with the pivot 17 for lever 14' on which the paper separating lever 12 is carried in the embodiment of FIG. 4. An end 34 of each releasing member 30*a*, 30*b* and 30*c* is opposed to a lower edge of a bent end of the paper feeding plate (see element 10*x* in FIG. 7) while the opposite end 35 is opposed to a tip of an adjustable screw 26 threaded into the tab 23 of its associated locking member 21*a*, 21*b* or 21*c*.

When a paper jam occurs between the paper feeding roller 11 and the paper separating plate 12 and such jamming must be remedied, the paper feeding plate (not shown) may be depressed with one hand by an operator. The end 34 of the releasing member is thereby rotated downwards by the lower edge of the bent end as indicated by an arrow. In consequence, the locking member is urged by the opposite end 35 of the releasing member through the adjustable screw 26 and the tab 23 in the direction of disengagement. Continuing depression of the paper feeding plate, the lower edge of the bent end thereof also bears against the upper edge of the lever 14*a*, 14*b* or 14*c* carrying the paper separating plate 12 and depresses the lever downwardly, so that such depression of the paper feeding plate causes the paper separating plate 12 to move away from the paper feeding roller 11. Accordingly, it is readily possible in this situation for the operator to depress the paper feeding plate with one hand and to remove a jammed paper sheet with his other hand and, thereafter, to bring the respective members back to their initial operative conditions automatically under restoring forces of the respective springs associated with the respective members, merely by releasing the depressing hold on the paper feeding plate. Thus, restoration of the lever 14*a*, 14*b* or 14*c* and its associated locking member 21*a*, 21*b* or 21*c* together with the other members cooperating to regulate the gap defined between the paper feeding roller 11 and the paper separating plate 12, can be brought again to the optimal positions in an automatic manner and immediately thereafter a next operation can be started.

Figure 6A:
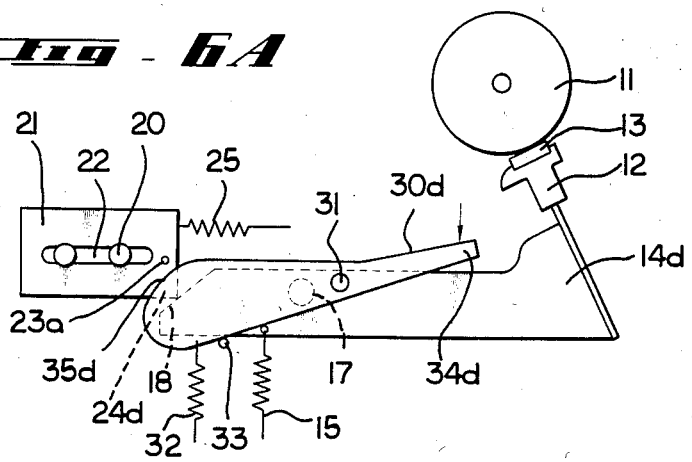
FIG. 6A and FIG. 6B schematically illustrate still other embodiments having the respective releasing members of different forms consisting of cam edges and stoppers, respectively.
Figure 6B:
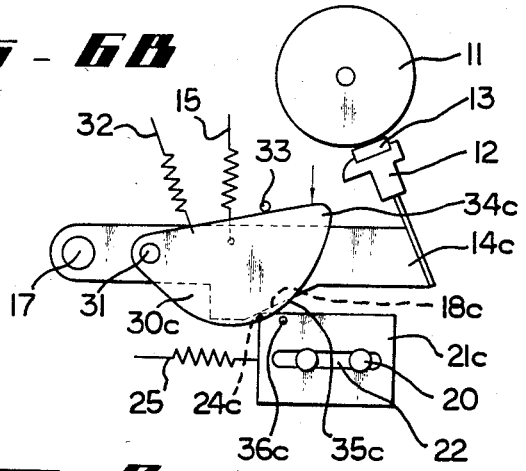

FIG. 6A and FIG. 6B illustrate embodiments respectively including releasing member 30*d* and 30*e* of different shapes. Also in these figures, the major components have been assigned letter suffix designations and the remaining members having the same functions as in the previous embodiment of FIG. 4 are designated by the same reference numerals. These two embodiments each utilize, as an actuating portion of the releasing members 30*d* and 30*e*, cam edges 35*d* and 35*e*, respectively. The locking members 21*d* and 21*e* each provide a pin 36, instead of the tab 23 and the adjustable screw 26. These two embodiments operate substantially in the same manner as the previous embodiments of FIGS. 5A through 5C and, therefore, further description is not provided here.

Figure 7:
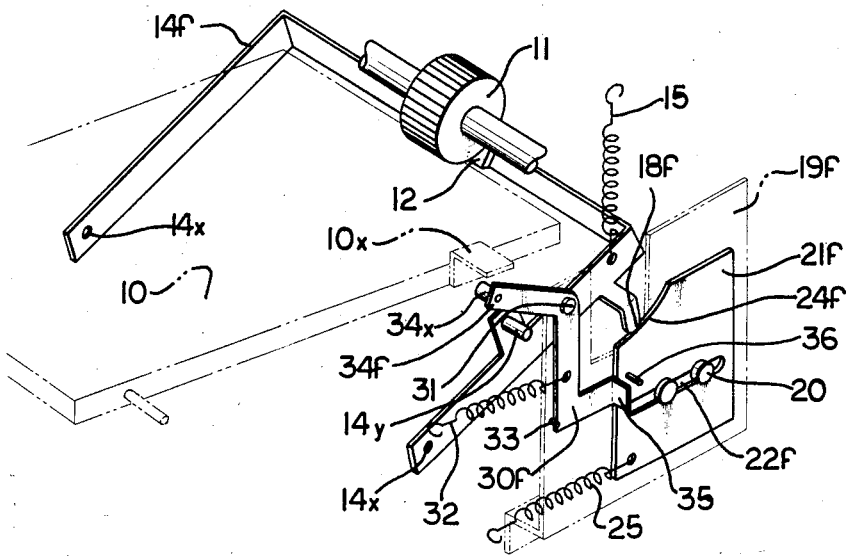
FIG. 7 illustrates, in a perspective view, an embodiment of the double-feed prevention device constructed according to the present invention particularly suitable as a large-sized, multistaged paper feeding apparatus.

Referring to FIG. 7, there is shown an embodiment of the apparatus constructed in accordance with the present invention particularly suitable as a multistaged paper feeding apparatus useful in a large-sized collating machine. Once again, the major components are identified by the same number as in prior embodiments with the addition of a letter suffix, and the remaining members having the same functions as described above are designated by the same reference numerals.

In the case of a collating machine or a like apparatus employing a large-sized multistaged paper feeding apparatus, a plurality of the paper feeding plates 10 are vertically arranged with small spacings one from another so as to prevent a mechanism as shown in FIG. 4 from being incorporated easily within the intermediate spacing of the paper feeding plates 10. As an alternative arrangement in such cases, a U-shaped lever 14*f* is swingably supported in a machine frame (not shown) by a pivot hole 14*x* and placed under a biasing effect of the spring 15 so that the paper separating plate 12 affixed to a bridge or bight of the lever 14*f* at a middle point thereof is normally biased against the paper feeding roller 11. On the outer side of the machine frame, the supporting plate 19*f* mounted thereon carries the locking member 21*f* formed with the slit 22*f* through which the laterally spaced screws 20, 20 are threaded into said supporting plate 19*f*, the locking member 21*f* being slidable along these screws relative to the supporting plate 19*f*. The locking member 21*f* is laterally biased under a traction of the spring 25 so that the actuating portion 24*f* formed as a slant edge (having a slight curve in this embodiment) along a part of the upper edge of the locking member is always in engagement with a tip (having a small radius of curvature) of an inverted L-shaped tab projecting from one side of the lever 14*f*, the tip serving as the portion 18*f* to be actuated.

The releasing member 30*f* is supported on the pivot 31 and biased under a traction of the spring 32 to bear against a stopper 33. The locking member 21*f* is normally biased towards this releasing member 30*f*. The member 30*f* is provided at one end 34 with a pin 34*x* adapted to be opposed to a tab 10*x* extending from the paper feeding plate 10. The lower edge of the end 34*f* adjacent the pin 34*x* is opposed to a pin 14*y* mounted on the lever 14*f* at its one side. The opposite end 35 of the member 30*f* is off-set in an L-shape so as to be opposed to the pin 36 mounted on the locking member 21*f*.

This embodiment functions substantially in the same manner as the previously described embodiments. Accordingly, the lever 14*f* swings counterclockwise as seen in FIG. 7 under a traction of the spring 15 as wear occurs in the surface of the paper feeding roller 11 during use of the device. The locking member 21*f* remains in engagement with the lever 14*f* as the former moves under the traction of the spring 25 in pursuance of the swinging of the lever 14*f*. Thus, the locking member 21*f* is automatically moved in a lateral direction. In consequence, the frictional member 13 carried on the paper separating plate 12 cannot be spaced from the paper feeding roller 11 beyond a predetermined dimension, in spite of the wear in the surface of the paper feeding roller 11, due to said following movement of the locking member 21*f* and the gap formed therebetween can always be maintained in the same condition as the initial dimension prior to occurrence of said wear in the surface of the paper feeding roller 11. When a paper jam occurs between the paper feeding roller 11 and the paper separating plate 12 and it is necessary to remove jammed paper, the paper feeding plate 10 is depressed with one hand and thereby the end 34 of the releasing member 30*f* is also depressed by the tab 10*x* extending from said paper feeding plate 10 through the pin 34*x*, so that the locking member 21*f* is forcibly released by the opposite end 35 of the lever-30*f* through the pin 36. Depression of the paper feeding plate causes the lower edge of the end 34*f* of the releasing member 30*f* to depress the lever 14*f* carrying the paper separating-plate 12, so the paper separating plate 12 can also be simultaneously disengaged from the paper feeding roller 11. Thus, the jammed paper sheet can easily be removed in this state with the other hand. Thereafter, the depressive hold on the paper feeding plate may be released to bring the respective members back to their initial operative positions automatically under the restoring force of the springs associated with them. Thus, the respective members are immediately ready for a successive paper feeding operation.

As will be obviously understood from the foregoing description, the double-feed prevention device according to the present invention can achieve the following effects. The locking member, slidably biased as above-mentioned, is always engaging a part of the swingable lever for the paper separating plate. Accordingly, even when wear occurs in the surface of the paper feeding roller, it is possible to maintain the gap defined between the paper feeding roller and the frictional member carried by the paper separating plate in the same dimension as the initial condition prior to occurrence of the wear in the paper feeding roller. This enables a stable paper feeding performance and prevents a double-feed of paper sheets. Unlike the mechanism of the prior art device (FIG. 3) wherein the stopper must be position-adjusted each time the members such as the paper feeding roller and the frictional member carried by the paper separating plate are repaired or exchanged, the present invention completely eliminates such need for the position-adjustment.

Also with the mechanism of the prior art device, when a paper sheet is jammed between the paper feeding roller and the frictional member carried by the paper separating plate such jammed paper sheet must be removed after the stopper has been loosened or dismounted, and then the stopper must be set again for optimal position. In contrast, the device according to the present invention includes the releasing member actuation which permits the jammed paper sheet to be easily removed. In the preferred embodiment of the present invention, the releasing member can be actuated merely by depressing the paper feeding plate and thereafter the engagement between the part of the swingable lever and the locking member is automatically restored in its optimal condition and the device is immediately ready for a successive paper feeding operation.

What is claimed is:

1. A double-feed prevention device to feed single sheets of paper from a stack of paper sheets placed on a paper feeding plate including a paper feeding roller in opposition to a paper separating means provided at an end of a resiliently biased swingable lever means arranged to move the paper separating means against the paper feeding roller and being adapted for pivotal movement in a substantially vertical plane, comprising a locking means secured by guiding means to a stationary supporting means, said locking means being adapted to slideably move parallel to said swingable lever means plane of movement, said locking means having a part thereof to be engaged with a part of the swingable lever means to prevent the paper separating means from moving away from the paper feeding roller, said locking means being biased to slide in a direction such that said locking means part is urged into engagement with said swingable lever means part and moves in response to movement of said swingable lever means part.

2. A double-feed prevention device as set forth in claim 1, wherein the engagement of said locking member and said swingable lever occurs between a slant portion and a corner portion of either of said elements.

3. A double-feed prevention dvice as set forth in claim 1, wherein said device further includes a releasing means for disengaging of said locking member and said swingable lever.

4. A double-feed prevention device as set forth in claim 3, wherein said paper feeding plate includes a lower edge and said locking member includes a portion located in opposition to said lower edge, the disengagement of said locking member and said swingable lever permitting said feeding plate lower edge to push said portion of said locking member.

5. A double-feed prevention device as set forth in claim 3, wherein said releasing means comprises a releasing member and a protrudent part of said locking mem ber.

6. A double-feed prevention device as set forth in claim 5, wherein said releasing member comprises a stopper and a lever biased by a spring.

7. A double-feed prevention device as set forth in claim 5, wherein said releasing member comprises a stopper and a plate having a cam edge biased by a spring.

8. A double-feed prevention device as set forth in claim 5, wherein said protrudent part is a screw mounted on a tab of the locking member.

9. A double-feed prevention device as set forth in claim 5, wherein said protrudent part is a pin mounted on the locking member.

* * * * *